US006335704B1

(12) United States Patent
Nakamura

(10) Patent No.: US 6,335,704 B1
(45) Date of Patent: Jan. 1, 2002

(54) ANTENNA DEVICE

(75) Inventor: Kiyoshige Nakamura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/664,575

(22) Filed: Sep. 18, 2000

(30) Foreign Application Priority Data

Mar. 31, 2000 (JP) ..... 12-099504

(51) Int. Cl.[7] ..... H01Q 1/38
(52) U.S. Cl. ..... 343/700 MS; 343/846
(58) Field of Search ..... 343/700 MS, 846, 343/848, 833, 834, 844; H01Q 1/38

(56) References Cited

U.S. PATENT DOCUMENTS 5,309,164 A * 5/1994 Dienes et al. ..... 343/700 MS
5,317,324 A * 5/1994 Naito et al. ..... 343/700 MS
5,576,718 A * 11/1996 Buralli et al. ..... 343/700 MS
5,945,951 A * 8/1999 Monte et al. ..... 343/700 MS
6,069,586 A * 5/2000 Karlsson et al. ..... 343/700 MS

* cited by examiner

*Primary Examiner*—Hoanganh Le
(74) *Attorney, Agent, or Firm*—Oblon, Spivak, McClelland, Maier & Neustadt, P.C.

(57) ABSTRACT

The non-powered short-patch antenna element is disposed on a ground plate below a plurality of flat antenna elements provided in an indoor-type antenna device, wherein the distance between the uppermost portion of the short-patch antenna element and that of the flat antenna element is set to the length of ½ wavelength. Due to this construction, the communication quality between the base plate and a mobile station at a remote place from the base plate can be greatly improved without interference caused otherwise by the electromagnetic wave below the antenna device.

14 Claims, 8 Drawing Sheets

FIG.3A
FIG.3B
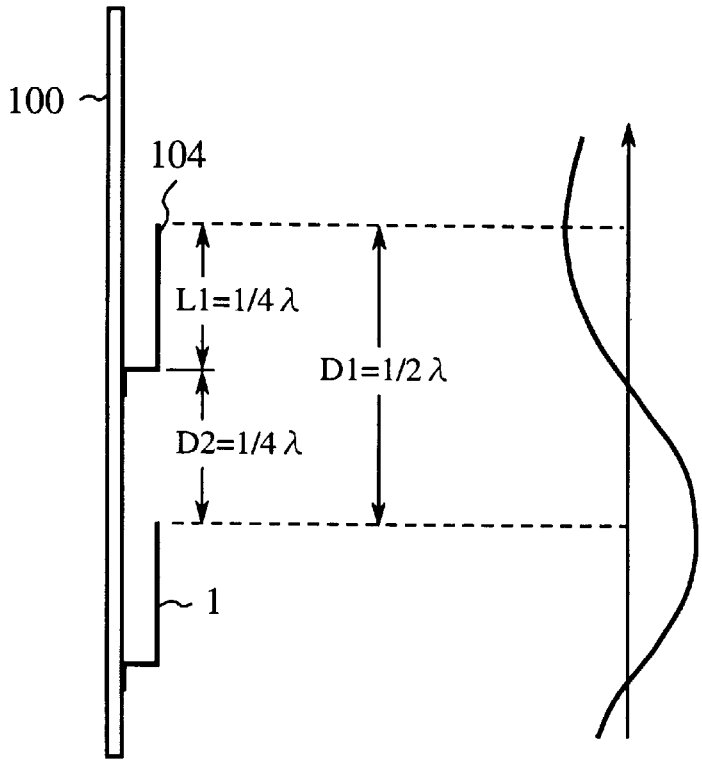
FIG.4A
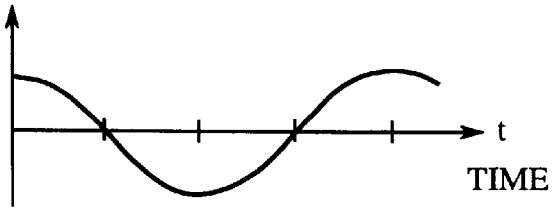
FIG.4B
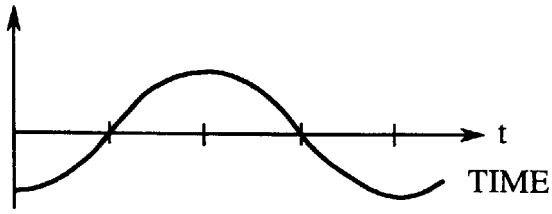

(RADIATION PATTERN IN THE VERTICAL DIRECTION)

ANTENNA DEVICE

BACKGROUND OF THE INVENTION

1. Field of the Invention

The present invention relates to an antenna device for use in an indoor type radio base station.

2. Description of the Related Art

FIGS. 12A and 12B are illustrations showing the positional configuration of a plurality of flat antennas mounted in a conventional antenna device, wherein FIG. 12A is a front view and FIG. 12B is a side view. FIGS. 13A and 13B are magnified views respectively of the antenna device of FIG. 12A and FIG. 12B showing one of the flat antennas mounted therein, wherein FIG. 13A is a sectional view observed from the line cut along I—I of FIG. 12A, and FIG. 13B is a plain view of that flat antenna. Further, FIG. 14 is a block diagram showing a configuration of the conventional antenna device.

In these figures, reference numeral 100 denotes a rectangular ground plate, which is fixed along a wall surface within a house and supporting each of the flat antennas, the detail of which is explained later, numerals 101 to 106 are flat antennas which are supplied with electric power, and disposed on the ground plate 100 with a predetermined distance from one another, and numeral 107 denotes a covering stuff, which is 3.0 mm thick and made of a resin material such as ABS resin or the like.

In close proximity to the upper corners of the ground plate 100, a flat antenna 101 and another flat antenna 102, which are used for signal transmission, are disposed at a predetermined distance away from the edge surface of the ground plate 100 so as to prevent reduction of the gains of these flat antennas 101 and 102. On the other hand, in close proximity to the lower corners of the ground plate 100, a flat antenna 103 and another flat antenna 104, which are used for signal reception, are disposed at a predetermined distance away from the edge surface of the ground plate 100 or from each other so as to prevent reduction of the gain of these flat antennas 103 and 104, and also to eliminate the mutual effect on each other. Specially, the flat antennas 103 and 104 provided as the signal reception antennas are disposed at a predetermined distance away from each other for eliminating the mutual effects, in order that they function together as a diversity antenna. Further, flat antennas 106 and 105 are disposed between the flat antennas 101 and 102 and also between the flat antennas 103 and 104 respectively, each as an interference detection antenna for searching for a radio wave that can be an interference for communications of the base station.

Since the flat antennas 101 to 106 have more or less the same configuration except their exact dimensions, the flat antenna 104 is taken up here as an example for explaining the construction thereof.

The flat antenna 104 is schematically composed of, as shown in FIGS. 13A and 13B, a radiation conductor portion 104*a* disposed in parallel to the surface of the ground plate 100 at a predetermined distance therebetween, a ground conductor portion 104*b* in contact with the surface of the ground plate 100, and a bent portion 104*c* connecting these conductor portions 104*a* and 104*b*. The radiation conductor portion 104*a* is configured in such a manner as to be supplied with electric power by way of a supporting member 111 having an RF connector 110, whereas an insulation spacer 112 for maintaining the distance H between the radiation conductor portion 104*a* and the ground plate 100 is provided at the far end of the radiation conductor portion 104*a*. The ground conductor portion 104*b* is fixed to the ground plate 100 in a rather easy way by a rivet 113. Note that only one side of the ground plate 100 is formed with a conductor pattern (not shown).

The length L1 of the radiation conductor portion 104*a* shown in FIG. 13A is determined in accordance with the frequency that the antenna uses, whereas the length L2 between the bent portion 104*c* and the power feeding point P is set in such a manner that the impedance becomes 50 ohm. The width W of the ground conductor portion 104*b* is determined by the gain of the antenna.

As shown in FIG. 14, the flat antennas (TX1) 101 and (TX2) 102 are transmission antennas, which are connected respectively to a first transmitter 120 and a second transmitter 121. The flat antenna (RX1) 103 is connected in a branched manner to a first receiver 123 and also to a third receiver 124 by way of an amplifier (AMP) 122, the flat antenna (RX2) 104 is connected in a branched manner to a second receiver 126 and also to a fourth receiver 127 by way of an amplifier (AMP) 125. The flat antenna (MX1) 105 is connected in a branched manner to the first receiver 123 and the second receiver 126 by way of an element 128 provided with the function of an amplifier and that of a frequency converter, and these first receiver 123 and second receiver 126 are connected to a first signal combiner 129. Further, the flat antenna (MX2) 106 is connected in a branched manner to the third receiver 124 and the fourth receiver 127 by way of an element 130 provided with the function of an amplifier and that of a frequency converter, and these third receiver 124 and fourth receiver 127 are connected to a second signal combiner 131.

In the antenna device configured as mentioned above, the first transmitter 120 and the second transmitter 121 use different frequencies from each other, which are different also from those of the receivers 123, 124, 126 and 127.

The operation of the conventional antenna device is as follows.

First of all, when a signal transmitted from the nearby area of the radio base station (hereinafter may be referred to as a radio station or just as a base station) is received by the flat antenna 105 that is an interference detection antenna, the thus received signal is amplified at the element 128 where a frequency conversion is processed, and thereafter sent to the first receiver 123 and the second receiver 126, wherein if the frequency of the thus received signal is same as that of the signals transmitted from the first transmitter 120 and the second transmitter 121, then the transmission of signals of the corresponding frequencies is prohibited in order to prevent a possible interference.

After the above procedure by use of the interference detection antenna, a signal transmission at a usable frequency is started. In this case, the TDMA (Time Division Multiple Access) communication is enabled by dividing one cycle of a transmitted signal into three portions, and also by allocating one frequency to three communication lines. In this antenna device, two transmitters 120 and 121 are used, wherein if the both frequencies are usable; each transmitter can hold three communication lines, so that communications of 6 lines can be assured in parallel by the whole antenna device. The communication using this time-division method can be applied even in the signal receiving case.

Next, in the case of signal receiving, the same one signal is received simultaneously by two different antennas; namely the flat antennas 103 and 104, and thereafter the thus received signals are amplified by the amplifiers 122 and 125, respectively, and the amplified signals are then fed through the first receiver 123 and the second receiver 126 to a first signal combiner 129 where these signals are combined after synchronizing the phase of each signal. This can be done by use of the diversity technique for improving the strength of signal reception.

It is to be noted here that the radiation pattern made of one flat antenna in the vertical direction is excellent not only about the directivity in the frontward direction, but also that in the upward and downward directions as well, as shown in FIG. 15.

It is also to be noted that since this kind of antenna device is used in a base station 133 mounted at the upper side of an inner wall surface inside a building 132 as shown in FIG. 16, there is a case in which a mobile station a at a nearby area from the base station 133 and another mobile station bat a remote place from the base station 133 make a communication with each other by way of the base station 133.

However, since attenuation of a signal transmitted from the mobile station b becomes greater in proportion to the distance between the mobile station b and the base station 133, the signal transmitted from the mobile station a becomes an interference to the signal transmitted from the mobile station b, so that there has been a problem that the communication quality of the mobile station b is degraded.

The present invention has been proposed to solve the problems aforementioned, and it is an object of the present invention to provide an antenna device which is capable of maintaining the communication quality of a mobile station, which is in a remote place from its base station.

SUMMARY OF THE INVENTION

In order to achieve the above object, an antenna device according to a first aspect of the present invention is constructed in such a manner that it comprises: a ground plate uprightly mounted in the vertical direction, one or more than one flat antenna elements disposed on the ground plate for receiving a signal transmitted from a mobile station, and a non-powered short-patch antenna element disposed on the vertically upright ground portion below at least one of the flat antenna elements, Wherein the distance between the uppermost portion of the short-patch antenna element and the uppermost portions of the flat antenna elements is the length of ½ wavelength.

An antenna device according to another aspect of the present invention is constructed such that the short-patch antenna element is shared by at least one pair of the flat antenna elements.

An antenna device according to further aspect of the present invention is constructed such that the above one or more than one flat antenna elements are disposed mutually close to each other, and at least a pair of non-powered antenna elements are disposed in such a manner as to vertically extend between the plurality of flat antenna elements.

An antenna device constructed as above further comprises metal fixing elements for fixing the pair of non-powered antenna elements to the ground plate, which metal fixing elements protruding from the non-powered antenna elements in the direction intersecting the direction of the electric field at right angles.

An antenna device according to further aspect of the present invention is constructed such that each of the non-powered antenna elements is formed with a spacer at the respective end portions thereof for suppressing vibrations possibly transmitted from the ground plate, which spacer being made of an electrically insulative material.

An antenna device according to still further aspect of the present invention is constructed such that the metal fixing elements and the ground plate are electrically insulated from each other.

An antenna device according to still further aspect of the present invention is constructed such that the insulation is performed by slits formed in the surface of the ground plate around the respective metal fixing elements.

An antenna device according to yet still further aspect of the present invention is constructed such that the non-powered short-patch antenna is an elongate plate extending along the lowermost edge portion of the ground plate throughout all the range from left to right.

BRIEF DESCRIPTION OF THE DRAWINGS

FIGS. 1A and 1B are illustrations showing an antenna device according to a first embodiment of the present invention, wherein FIG. 1A is a plain view and FIG. 1B is a side view thereof.

FIGS. 3A and 3B are illustrations showing the positional relation between a flat antenna element and a short-patch antenna element of the antenna device shown in FIGS. 1A and 1B, and also showing the distribution of the electric field thereof, wherein FIG. 3A is a side view showing the magnified view of these two antenna elements and FIG. 3B is an illustration showing distribution of the electric field of the electromagnetic wave from the range below the short-patch antenna element.

FIGS. 4A and 4B are illustrations showing the change in the electric field induced by the electromagnetic wave from the range below the antenna device of FIGS. 1A and 1B in accordance with the lapse of time, wherein FIG. 4A is a graph showing the change in the electric field induced by the powered antenna element in accordance with the lapse of time, and FIG. 4B is a graph showing the change in the electric field induced by the non-powered short-patch antenna element in accordance with the lapse of time.

FIGS. 6A and 6B are illustrations showing an antenna device according to a second embodiment of the present invention, wherein FIG. 6A is a plan view and FIG. 6B is a side view thereof.

FIGS. 7A and 7B are illustrations showing an antenna device according to a third embodiment of the present invention, wherein FIG. 7A is a plan view and FIG. 7B is a side view thereof.

FIGS. 12A and 12B are illustrations showing the positional structure of the flat antennas in a conventional antenna device, wherein FIG. 12A is a plan view and FIG. 12B is a side view thereof.

FIGS. 13A and 13B are illustrations showing the magnified view of the flat antenna element mounted in the antenna device shown in FIGS. 12A and 12B, wherein FIG. 13A is a sectional view observed from the line cut along I—I of FIG. 12A, and FIG. 13B is a plain view of that flat antenna.

DETAILED DESCRIPTION OF THE PREFFERED EMBODIMENTS

Several embodiments of the present invention are now explained with reference to the accompanying drawings.

First Embodiment

Figure 1A:
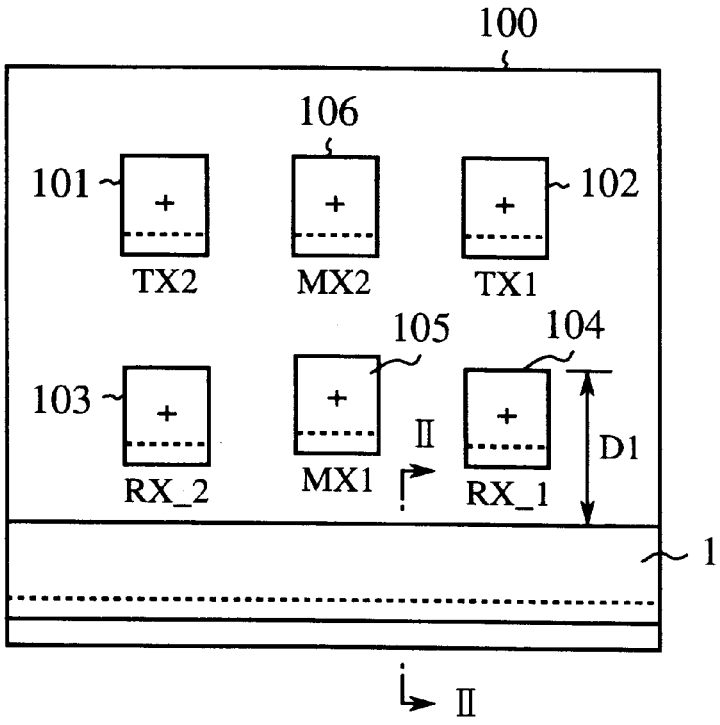
Figure 1B:
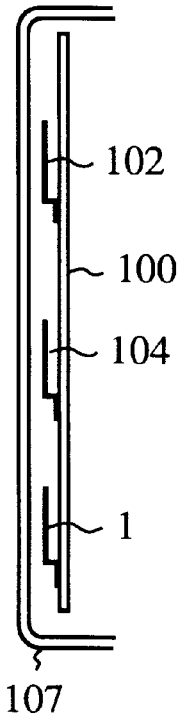
Figure 2:
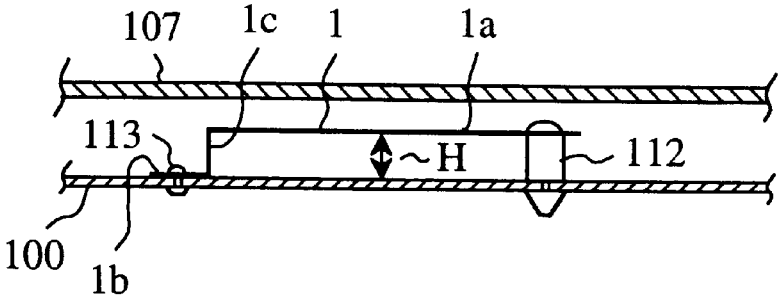
FIG. 2 is a sectional view of FIG. 1 observed from a line cut along II—II.

FIGS. 1A and 1B are illustrations showing an antenna device according to a first embodiment of the present invention, wherein FIG. 1A is a plain view and FIG. 1B is a side view thereof. FIG. 2 is a sectional view of FIG. 1 observed from a cut line along I—I FIGS. 3A and 3B are illustrations showing the positional relation between a flat antenna (hereinafter may be referred to as a flat antenna element, or just as a powered antenna element) and a short-patch antenna element of the antenna device shown in FIGS. 1A and 1B and also the distribution of the electric field thereof, wherein FIG. 3A is a side view showing the magnified view of these two antenna elements and FIG. 3B is an illustration showing the distribution of the electric field of the electromagnetic wave applied from the range below the short-patch antenna element.

Note that the short-patch antenna element is not supplied with electric power in contrast to the flat antenna elements, and thus it is referred to as a non-powered short-patch antenna element hereinafter.

FIGS. 4A and 4B are illustrations showing the change in the electric field induced by the electromagnetic wave from the range below the antenna device of FIGS. 1A and 1B in accordance with the lapse of time, wherein FIG. 4A is a graph showing the change in the electric field induced by the powered antenna element in accordance with the lapse of time, and FIG. 4B is a graph showing the change in the electric field induced by the non-powered short-patch antenna element in accordance with the lapse of time.

Figure 5:
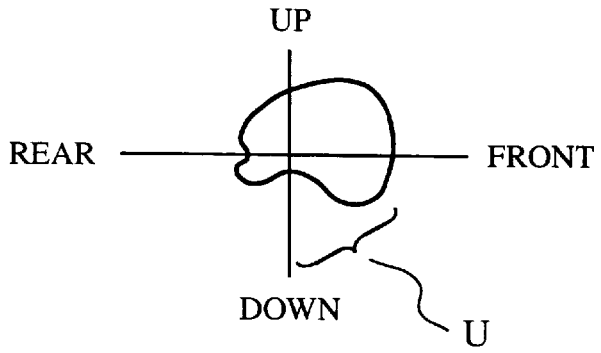
FIG. 5 is an illustration showing the characteristic of the radiation pattern in the vertical direction of the reception antennas in the antenna device of FIGS. 1A and 1B.

FIG. 5 is an illustration showing the characteristic of the radiation pattern in the vertical direction of the reception antennas in the antenna device of FIGS. 1A and 1B.

Within the structural elements configuring the antenna device of this first embodiment, the same reference numerals are put to the elements same or similar to those configuring the conventional antenna device shown in FIGS. 12A, 12B to FIG. 14, and the explanation thereabout is thus omitted here.

In these figures, reference numeral 1 denotes a non-powered short-patch antenna element disposed on the ground plate 100 below the flat antennas 103 and 104 thereon as signal reception antennas. This non-powered short-patch antenna 1 is a an elongate plate extending along the lowermost edge portion of the ground plate 100 throughout all the range from left to right, and its configuration is same as that of each of the flat antennas 101 to 106 shown in FIG. 2, except that it is not provided with a power feeding point. In other words, the non-powered short-patch antenna element 1 is schematically composed of a radiation conductor portion 1*a* disposed in parallel to the surface of the ground plate 100 at a predetermined distance therebetween, a ground conductor portion 1*b* in contact with the surface of the ground plate 100, and a bent portion 1*c* connecting these conductor portions 1*a* and 1*b*, wherein an insulation spacer 112 for maintaining the distance H between the radiation conductor portion 1*a* and the ground plate 100 is provided at the far end of the radiation conductor portion 1*a*. The ground conductor portion 1*b* is fixed to the ground plate 100 by a rivet 113 in a rather easy way.

Further, the distance D1 between the upper end of the non-powered short-patch antenna element 1 (the far end portion of the radiation conductor pattern 1*a*) and the upper end of the flat antenna 104 (the far end portion of the radiation conductor pattern 104*a*) is set to the length of ½ wavelength as shown in FIG. 3A. If the length L1 of the radiation conductor pattern 104*a* of the flat antenna 104 is set to the length of ¼ wavelength, it means the fact that the distance D2 between the far end of the radiation conductor pattern 1*a* of the non-powered short-patch antenna element 1 and the bottom end of the radiation conductor pattern 104*a* of the flat antenna 104 (which corresponds to the position of the bent portion 104*c*) is also set to the length of ¼ wavelength. The same arrangement is also applied to the flat antenna 103.

When the distance D1 is set to the length of ½ wavelength as mentioned above, the distribution of the electric field of the electromagnetic wave from the range below the antenna device will be as shown in FIG. 3B, whereas the change in the electric field induced by, for example, the flat antenna 104 within the electromagnetic wave, and the change in the electric field induced by the non-powered short-patch antenna element 1 within the electromagnetic wave will be as shown in FIGS. 4A and 4B, respectively.

As is obvious from these graphs, the above-mentioned two electric fields are mutually opposite phases to offset each other, that is, the electric field below the flat antennas 103 and 104 can be eliminated by providing the non-powered short-patch antenna element 1 at the position downwardly away for the distance D1 from the flat antennas 103 and 104, and this means the fact that the directivity in the region below the flat antennas 103 and 104 is reduced. Further, the electric field induced by the non-powered short-patch antenna element 1 does not affect on the directivity of the flat antennas 103 and 104 either in the frontward or upward directions thereof.

Figure 15:
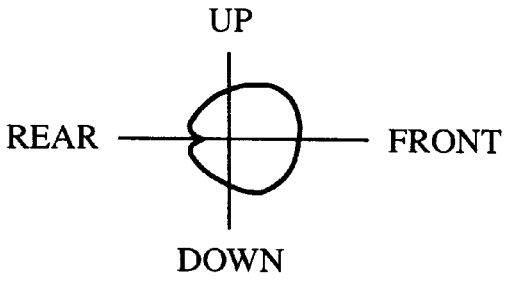
FIG.15 (PRIOR ART)
FIG. 15 is an illustration showing the characteristic of the radiation pattern in the vertical direction of the reception antenna in the conventional antenna device of FIGS. 12A and 12B.
Figure 16:
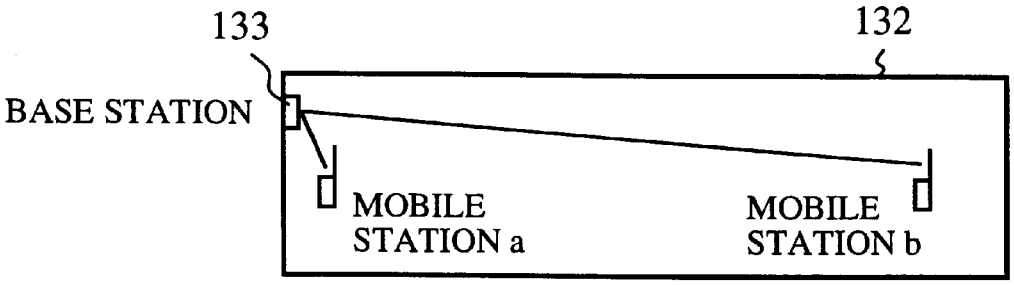
FIG.16 (PRIOR ART)
FIG. 16 is an explanatory view showing the problems to be solved in the conventional antenna device.

FIG. 5 is an illustration showing the characteristic of the radiation pattern in the vertical direction of the reception antennas such as 103 and 104 in the antenna device, wherein the directivity of this radiation pattern in the lower portion U is reduced in comparison with that of the radiation pattern in the vertical direction of the reception antenna shown in FIG. 15 in which there is no non-powered short-patch antenna element 1 mounted.

The basic operation of this antenna device is same as that of the conventional antenna device.

When using a conventional antenna device, the directivity in the lower portion U thereof is as good as that in the frontward and upward directions, so that in the case where the mobil station a residing at the range below a base station having the conventional antenna device starts communicating by way of the base station during the time in which the mobile station b at a remote place from the base station is communicating also by way of the same base station, there has been such a problem that the signal transmitted from the mobile station a interferes with the signal transmitted from the mobile station b, and the communication quality of the mobile station b is thus degraded.

However, in this first embodiment, since the directivity in the lower portion U of the antenna device is reduced by the non-powered short-patch antenna element, interference in another mobile station caused by a signal transmitted from the mobile station approaching to the region below the antenna device is mitigated, and deterioration of the communication quality of the mobile station b residing at a remote place from the antenna device is thus prevented, so that the service area that the base station can cover is greatly expanded.

Further, in this first embodiment, the non-powered short-patch antenna element 1 is made to be a long-length member, and is horizontally disposed in such a manner as to be connected to the lower positions of the flat antennas 103 and 104. On the other hand, the flat antennas 103 and 104 commonly use one non-powered short-patch antenna element 1. In this way, by sharing one non-powered short-patch antenna element among a plurality of powered antenna elements 103 and 104, disposition of one non-powered short-patch antenna element 1 for each of the flat antennas 103 and 104 is no longer needed, and the assembling operation thereof can be greatly facilitated. Further, it goes without saying that even when one non-powered short-patch antenna element is disposed for each of the flat antennas 103 and 104, the above-mentioned reduction of directivity in the lower region U of the flat antennas 103 and 104 can also be obtained.

Note that in this first embodiment, the flat antenna 105 as one of the interference detection antennas is disposed a bit farther from the non-powered short-patch antenna element 1 than those of the flat antennas 103 and 104 as reception antennas from the same, in order that the detection of interference by the flat antenna 105 does not receive any adverse effect of the non-powered short-patch antenna element 1. Further, the other flat antenna 106 is shifted upward in accordance with the upward shift of the flat antenna 105 in order to maintain the distance therebetween due to which they are not affected with each other.

Second Embodiment

Figure 6A:
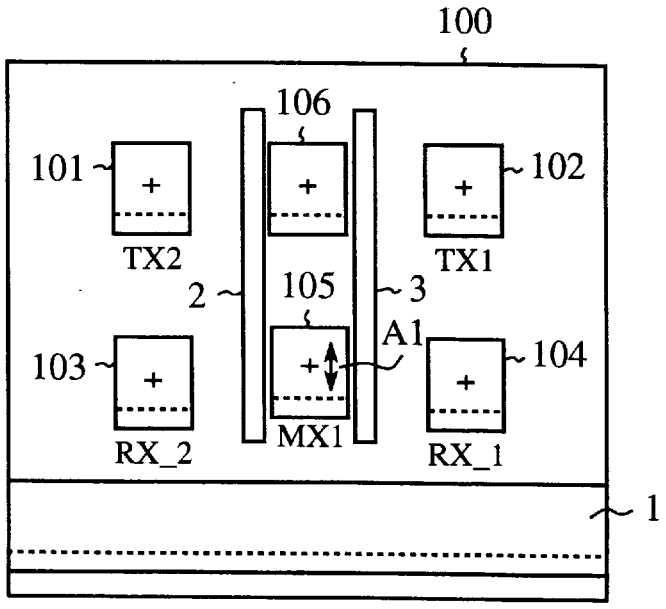
Figure 6B:
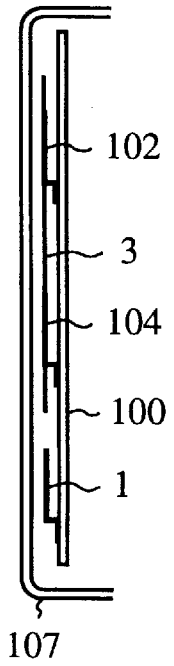

FIGS. 6A and 6B are illustrations showing an antenna device according to a second embodiment of the present invention, wherein FIG. 6A is a plain view and FIG. 6B is a side view thereof. Within the structural elements configuring the antenna device of this second embodiment, the same reference numerals are put to the elements same or similar to those configuring the antenna device of the first embodiment, and the explanation thereabout is thus omitted here.

In these figures, reference numeral 2 denotes a non-powered antenna element, which is disposed between the flat antenna 101 as a transmission antenna and the flat antenna 106 as an interference detection antenna disposed adjacent to the flat antenna 101 on the surface of the ground plate 100, and is also disposed between the flat antenna 103 as a reception antenna and the flat antenna 105 as an interference detection antenna disposed adjacent to the flat antenna 103 on the surface of the ground plate 100. Similarly, reference numeral 3 denotes a non-powered antenna element, which is disposed between the flat antenna 102 as a transmission antenna and the flat antenna 106 as an interference detection antenna disposed adjacent to the flat antenna 102 on the surface of the ground plate 100, and is also disposed between the flat antenna 104 as a reception antenna and the flat antenna 105 as an interference detection antenna disposed adjacent to the flat antenna 104 on the surface of the ground plate 100, these non-powered antenna elements 2 and 3 can be referred to as a "dipole element" as well. These non-powered antenna elements 2 and 3 are metal-made elongate plates, each having the length of 1 wavelength and is fixed by way of a spacer (not shown) made of an electrically insulative material such as styrene foam or the like mounted on the ground plate 100 that is provided upright in the vertical direction. For this reason, these non-powered antenna elements 2 and 3 are provided extendedly in the vertical direction. In this configuration, if the ground plate 100 and these non-powered antenna elements 2 and 3 are electrically connected, the effect of improving the deterioration of the radiation pattern made by these non-powered antenna elements 2 and 3 is greatly reduced, as the distribution of the electrical field induced by these non-powered antenna elements 2 and 3 is limited to the region in which electric potential at their connected portion to the ground plate is zero. Due to this, in order to eliminate this problem, the non-powered antenna elements 2 and 3 are insulated so as not to be electrically conducted to the ground plate 100.

The basic operation of this antenna device is same as that of the antenna device of the first embodiment.

It is to be noted here that the radiation pattern made of one flat antenna in the horizontal direction are made in such a manner that the level of the peak gain of the radiation pattern of the main polarized wave, which is the gain obtained by directing the longitudinal direction of an antenna (hereinafter referred to just as the antenna direction) to the direction of the electric field (the direction indicated by an arrow A1 in FIG. 6), is almost same as that of the peak gain of the radiation pattern of the cross-polarized wave, which is the gain obtained by directing the antenna to the direction intersecting the electric field at right angles. However, in the case where a plurality of flat antennas are closely disposed in a limited narrow area on the ground plate, the level of the gain of the cross-polarized wave is reduced by the effect of other flat antennas which are disposed at a distance shorter than the length of 1 wavelength.

In this second embodiment, since the non-powered antenna elements 2 and 3 are provided for separating the both flat antennas 105 and 106 from other flat antennas so as to reduce mutual effects on each other, deterioration of the radiation patterns of each of these flat antennas 105 and 106 in the horizontal direction can be prevented.

As explained above, according to this second embodiment, even when a plurality of flat antennas are disposed on a small-sized ground plate adjacent to each other, deterioration of the radiation patterns in the horizontal direction of each of the flat antennas can be prevented, and the characteristic of the radiation pattern of an independently mounted flat antenna can be maintained, so that an antenna device provided with such flat antennas can be made smaller.

It is to be noted that in this second embodiment, by setting one of the non-powered antenna elements; namely the non-powered antenna element 2 for example, in such a manner as to be shared by a plurality of antennas, provision of individual non-powered antenna elements for each of these flat antennas is no longer needed, facilitating thereby the mounting operation thereof.

Third Embodiment

Figure 7A:
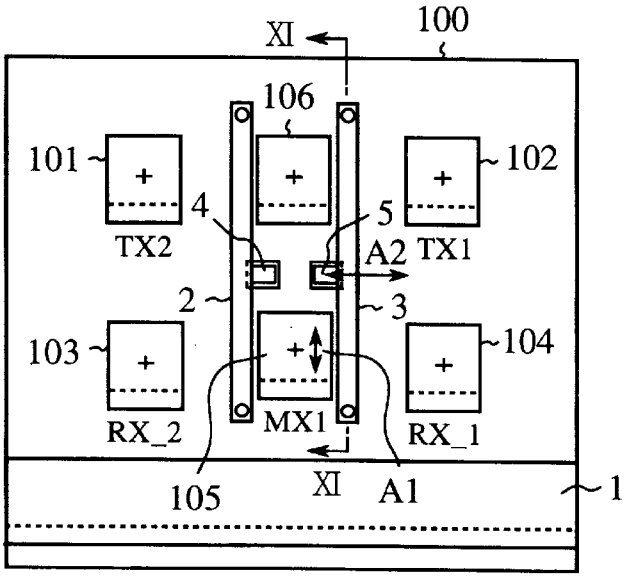
Figure 7B:
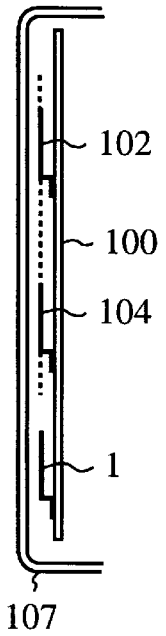
Figure 12A:
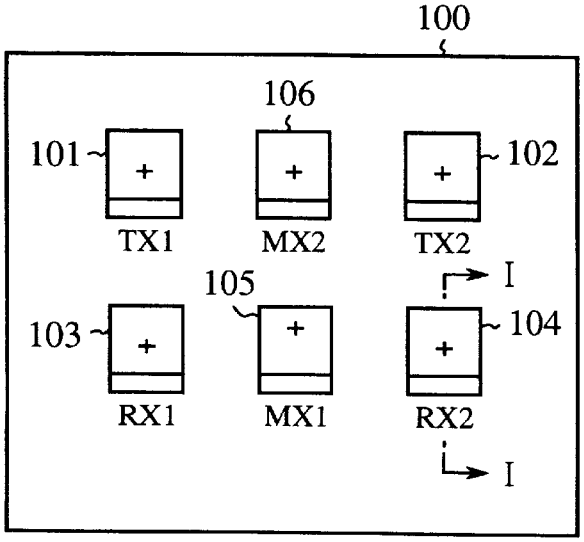
FIG.12A (PRIOR ART)
Figure 12B:
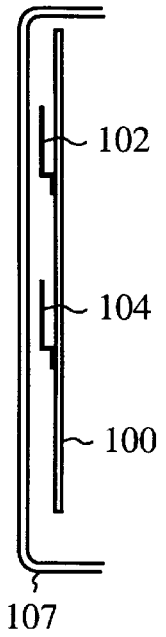
FIG.12B (PRIOR ART)
Figure 8:
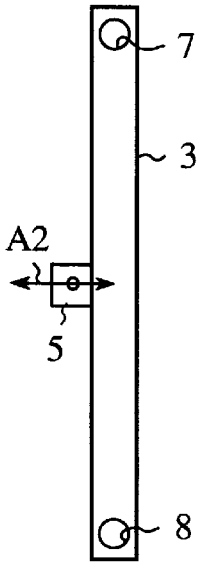
FIG. 8 is a plain view showing the magnified view of the non-powered antenna element shown in FIG. 7A.
Figure 9:
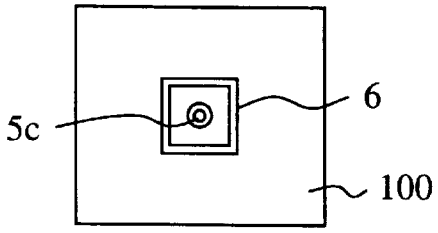
FIG. 9 is a plain view showing the magnified view of the metal fixing portion shown in FIG. 8.
Figure 10:
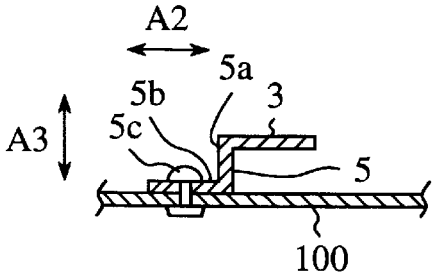
FIG. 10 is a sectional view showing the configuration of the metal fixing portion of FIG. 8 when it is mounted on the ground plate.
Figure 11:
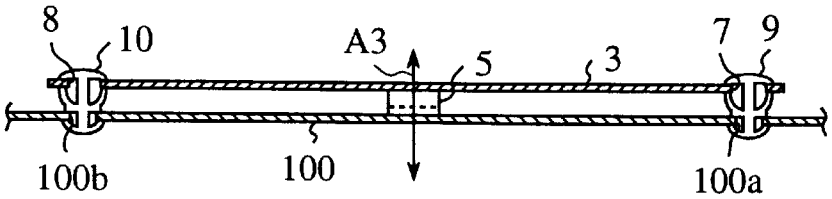
FIG. 11 is a sectional view observed from the line cut along XI—XI of FIG. 7A.
Figure 13A:
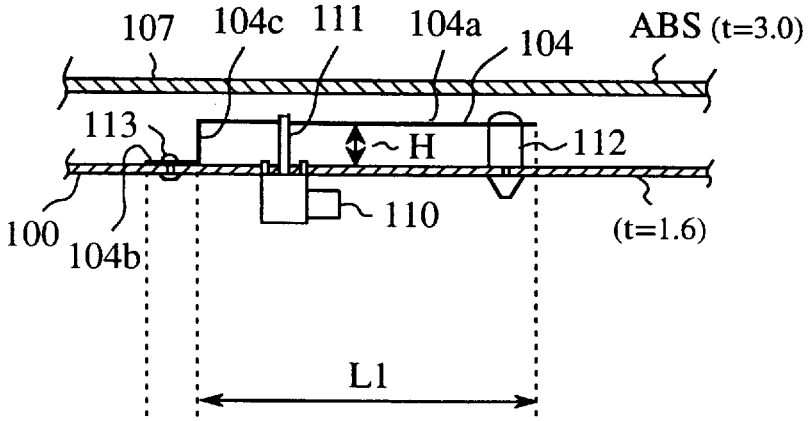
FIG.13A (PRIOR ART)
Figure 13B:
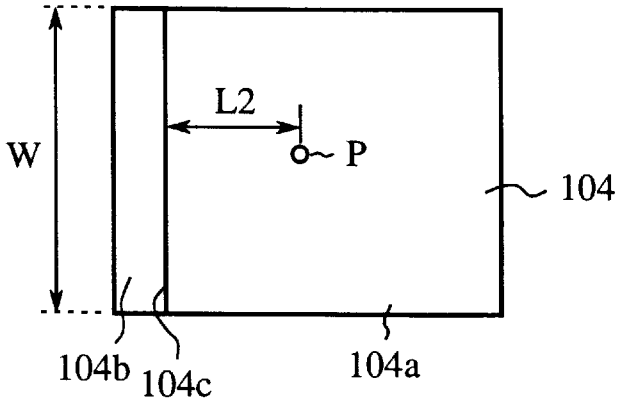
FIG.13B (PRIOR ART)
Figure 14:
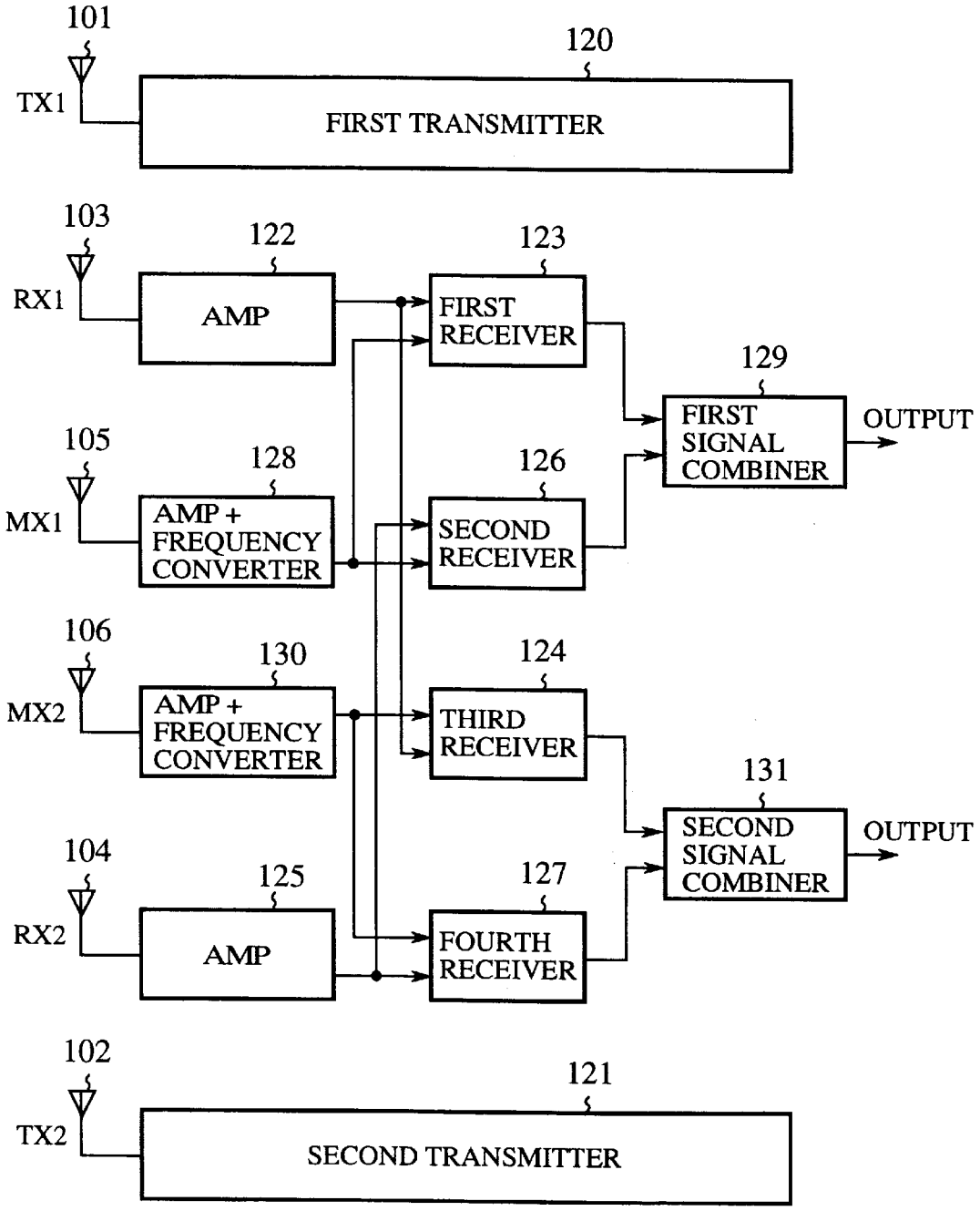
FIG.14 (PRIOR ART)
FIG. 14 is a schematic diagram showing a construction of the conventional antenna device.

FIGS. 7A and 7B are illustrations showing an antenna device according to a third embodiment of the present invention, wherein FIG. 7A is a plain view and FIG. 7B is a side view thereof. FIG. 8 is a plain view showing the magnified view of the non-powered antenna element shown in FIG. 7A. FIG. 9 is a plain view showing the magnified view of the metal-made fixing portion shown in FIG. 8. FIG. 10 is a sectional view showing the configuration of the metal-made fixing portion (hereinafter may be referred to just as a metal fixing portion) of FIG. 8 when mounted on the ground plate 100, and FIG. 11 is a sectional view observed from the line cut along XI—XI of FIG. 7A.

In this embodiment, in fixing the center portion of each of the non-powered antenna elements 2 and 3 of the second embodiment to the ground plate 100 respectively by way of the metal fixing elements 4 and 5, the metal fixing elements 4 and 5 are set in such a manner as to protrude from the corresponding non-powered antenna elements 2 and 3 in the direction (for instance, direction indicated by an arrow A2 in FIG. 7A) which is intersecting the direction of the electric field at right angles (direction indicated by an arrow A1 in FIG. 7A) induced by these non-powered antenna elements 2 and 3, which is the technical feature of this third embodiment.

In other words, if the metal fixing elements 4 and 5 are directly mounted to one part of the non-powered antenna elements 2 and 3, the non-powered antenna elements 2 and 3 respectively having the length of 1 wavelength are divided into two parts, and the electric field is destroyed, resulting in the reduction of the deterioration preventing characteristic of these non-powered antenna elements 2 and 3 with respect to the powered antenna elements. For this reason, by setting the metal fixing elements 4 and 5 in such a manner as to protrude in the direction intersecting the direction of the electric field at right angles (for instance, direction indicated by an arrow A2 in FIG. 7A), an adverse effect possibly caused by the metal fixing elements 4 and 5 on the deterioration preventing characteristic of the non-powered antenna elements 2 and 3 can be eliminated.

The metal fixing elements 4 and 5 are symmetrical to each other, and their configurations are basically the same. For example, the metal fixing element 5 is schematically composed of, as shown in FIG. 10, a vertical arm portion 5a extending in the direction indicated by an arrow A3 from the center portion of the side edge of the non-powered antenna element 3, a grounding portion 5*b* which extends from the lowermost end of this vertical arm portion 5*a* and is grounded to the ground plate 100, and also a rivet 5*c* for fixing this grounding portion 5*b* to the ground plate 100.

Although the grounding portion 5*b* of the metal fixing element 5 is grounded to the ground plate 100 as explained above, there is formed an insulation slit 6 around this grounding portion as shown in FIG. 9, by scraping the conductor pattern for example made of a copper film or the like formed in the ground plate 100. Because of this slit 6, the non-powered antenna element 3 can be electrically insulated from the ground plate 100, so that an adverse effect possibly caused by the metal fixing element 5 on the reduction of deterioration preventing effect in the radiation pattern of the non-powered antenna element 3 can be eliminated. Regarding this fact as well, the non-powered antenna element 2 has a same configuration as that of the non-powered antenna element 3.

Further, the non-powered antenna element 3 is formed with mounting grooves 7 and 8 at the opposite ends thereof, and on the ground plate 100, mounting grooves 100*a* and 100*b* are formed at the same position opposing to the above-explained groves 7 and 8. These mounting grooves 7 and 8 of the non-powered antenna element 3 side are linked to the mounting grooves 100*a* and 100*b* of the ground plate 100 side by anti-vibration spacers 9 and 10. The non-powered antenna element 3 is supported by the metal fixing element 5 in the center portion thereof, wherein if a vibration is transmitted to the ground plate 100, the non-powered antenna element 3 is also vibrated, so that the structure of the non-powered antenna element 3 can possibly be destroyed. In order to prevent this phenomenon, in this third embodiment the above-explained anti-vibration spacers 9 and 10 are provided for suppressing vibration of the non-powered antenna element 3. Note that the material for these spacers 9 and 10 can be any material as long as it is an electrically insulative material.

Regarding this fact as well, the non-powered antenna element 2 has the same configuration as that of the non-powered antenna element 3.

The basic operation of this antenna device is same as that of the antenna device of the second embodiment.

As explained above, according to this third embodiment, since the metal fixing elements 4 and 5 are arranged in such a manner as to protrude from the non-powered antenna elements 2 and 3 in the direction intersecting the direction of the electric field at right angles, an adverse effect possibly caused by these metal fixing elements 4 and 5 on the deterioration preventing characteristic of the non-powered antenna elements with respect to the flat antennas can be eliminated.

As explained heretofore, according to the present invention, since the non-powered short-patch antenna element is disposed below that powered antenna elements for the length of ½ wavelength away therefrom, the electric field induced by the powered antenna elements within the electromagnetic wave and that induced by the non-powered short-patch antenna elements within the electromagnetic wave from the range below the ground plate are mutually opposite phases to each other, whereby the directivity toward the region below the antenna device can be made small. Due to this, since the antenna device hardly receives electromagnetic waves from the range below itself, the interference caused by the signal transmitted from a mobile station approaching to the area below the antenna device is attenuated, and thereby reduction of the communication quality between the antenna device and another mobile station at a remote position from the antenna device can be prevented, and thus the service area that the base station can cover is magnified.

Further, according to the present invention, since one non-powered short-patch antenna element is shared by a plurality of powered antenna elements, provision of one non-powered short-patch antenna element for each of the flat antennas is no longer needed, and the assembling operation thereof can be greatly facilitated.

Further, according to the present invention, since non-powered antenna elements are disposed between the mutually adjacent powered antenna elements, when these antenna elements are disposed adjacent to each other at a distance shorter than the length of 1 wavelength, deterioration of the radiation patterns in the horizontal direction possibly caused by the effect of other flat antenna elements disposed therearound can be prevented. Subsequently, even if these antennas are disposed adjacent to each other, the radiation pattern thereof in the horizontal direction is not deteriorated, and thus the characteristic of an independently mounted flat antenna can be maintained, so that an antenna device provided with such flat antennas can be made small as a whole.

Further, according to the present invention, since the metal fixing portions for fixing the non-powered antenna elements to the ground plate are further included, and these metal fixing portions are set in such a manner as to protrude from the non-powered antenna elements in the direction intersecting at right angles with the direction of the electric field induced by the non-powered antenna elements, an adverse effect on the deterioration preventing characteristic of the non-powered antenna elements with respect to the flat antennas by these metal fixing elements 4 and 5 can be eliminated.

Still further, according to the present invention, since the metal fixing portions are insulated from the ground plate, limitation to the distribution of the electric field induced by the non-powered antenna elements can be eliminated, so that the deterioration preventing characteristic of the radiation patterns of the powered antenna elements in the horizontal direction by the non-powered antenna elements can be used at maximum efficiency.

What is claimed is:

1. An antenna device comprising:

a ground plate uprightly mounted in the vertical direction, at least one flat antenna element disposed on said ground plate and configured to receive a signal transmitted from a mobile station, and a non-powered short-patch antenna element disposed on said ground plate below at least one of said at least one flat antenna element, wherein the distance between the uppermost portion of said short-patch antenna element and the uppermost portion of said at least one flat antenna element is ½ the wavelength of the signal received from the mobile station.

2. The antenna device according to claim 1, wherein said short-patch antenna element is common to at least one pair of said at least one flat antenna element.

3. The antenna device according to claim 2, wherein at least one pair of said at least one flat antenna element are disposed mutually close to each other, and at least a pair of non-powered antenna elements are disposed in such a manner as to vertically extend between said at least one pair of said at least one flat antenna element.

4. The antenna device according to claim 2, said non-powered short-patch antenna is an elongate plate extending along the lowermost edge portion of said ground plate throughout all the range in its lateral direction.

5. The antenna device according to claim 1, wherein a plurality of at least one flat antenna element are disposed mutually close to each other, and at least a pair of non-powered antenna elements are disposed in such a manner as to vertically extend between said plurality of at least one flat antenna element.

6. The antenna device according to claim 5, further comprising:

metal fixing elements configured to fix said at least one pair of non-powered antenna elements to said ground plate, said metal fixing elements protruding from said non-powered antenna elements in the direction intersecting the direction of the electric field at right angles.

7. The antenna device according to claim 6, wherein each of said non-powered antenna elements is formed with a spacer at the respective end portions thereof configured to suppress vibrations possibly transmitted from said ground plate, said spacer being made of an electrically insulative material.

8. The antenna device according to claim 6, wherein said metal fixing elements and the ground plate are electrically insulated from each other.

9. The antenna device according to claim 8, wherein said insulation is formed from slits formed in the surface of the ground plate around said respective metal fixing elements.

10. The antenna device according to claim 1, wherein said non-powered short-patch antenna is an elongate plate extending along the lowermost edge portion of said ground plate throughout all the range in its lateral direction.

11. The antenna device according to claim 10, further comprising:

metal fixing elements configured to fix at least one pair of non-powered antenna elements to said ground plate, said metal fixing elements protruding from said non-powered antenna elements in the direction intersecting the direction of the electric field at right angles.

12. The antenna device according to claim 11, wherein each of said non-powered antenna elements is formed with a spacer at the respective end portions thereof configured to suppress vibrations possibly transmitted from said ground plate, said spacer being made of an electrically insulative material.

13. The antenna device according to claim 11, wherein said metal fixing elements and the ground plate are electrically insulated from each other.

14. The antenna device according to claim 13, wherein said insulation is performed by slits formed in the surface of the ground plate around said respective metal fixing elements.

* * * * *